US008056989B2

(12) United States Patent
Zielinski

(10) Patent No.: US 8,056,989 B2
(45) Date of Patent: Nov. 15, 2011

(54) CHILD-PROOF SAFETY LATCH

(76) Inventor: Randall S. Zielinski, Madbury, NH (US)

( * ) Notice: Subject to any disclaimer, the term of this patent is extended or adjusted under 35 U.S.C. 154(b) by 583 days.

(21) Appl. No.: 12/283,189

(22) Filed: Sep. 10, 2008

(65) Prior Publication Data

US 2009/0066203 A1 Mar. 12, 2009

Related U.S. Application Data

(60) Provisional application No. 60/993,121, filed on Sep. 10, 2007.

(51) Int. Cl.
*E05B 65/46* (2006.01)

(52) U.S. Cl. .... 312/215; 312/333; 292/84; 292/DIG. 38

(58) Field of Classification Search ..... 312/333, 312/215, 330.1; 292/80, 81, 84, 87, 89, 303, 292/DIG. 38, DIG. 63
See application file for complete search history.

(56) References Cited

U.S. PATENT DOCUMENTS

| | | | | |
|---|---|---|---|---|
| 3,381,992 | A | 5/1968 | Friesen | |
| 3,397,001 | A | 8/1968 | Friedman | |
| 3,850,463 | A | 11/1974 | Hawkins | |
| 3,879,072 | A | 4/1975 | Tuley | |
| 3,889,992 | A | 6/1975 | Shelton | |
| 3,971,237 | A | 7/1976 | Rasmussen | |
| 4,139,249 | A * | 2/1979 | Hillman | 312/333 |
| 4,191,411 | A | 3/1980 | Rodgers | |
| 4,286,809 | A | 9/1981 | Godwin | |
| 4,378,948 | A | 4/1983 | Chrones | |
| 4,416,477 | A | 11/1983 | Bialobrzeski | |
| 4,505,526 | A | 3/1985 | Leck | |
| 4,632,438 | A | 12/1986 | McKinney | |
| 4,714,284 | A | 12/1987 | Varlet | |
| 4,717,184 | A * | 1/1988 | Boyce | 292/87 |
| 4,993,762 | A * | 2/1991 | Rogers et al. | 292/303 |
| 5,255,983 | A | 10/1993 | Parvin | |
| 5,344,226 | A | 9/1994 | Lee | |
| 5,445,451 | A | 8/1995 | Harmony | |
| 5,556,141 | A | 9/1996 | Rogers | |
| 5,626,372 | A * | 5/1997 | Vogt | 292/87 |
| 5,645,304 | A | 7/1997 | Richardson et al. | |
| 5,647,618 | A * | 7/1997 | Lamberth | 292/19 |
| 5,671,957 | A | 9/1997 | Raffini | |
| 5,730,514 | A | 3/1998 | Hashemi | |
| 5,769,517 | A * | 6/1998 | Carde | 312/333 |
| 5,795,044 | A | 8/1998 | Trewhella et al. | |
| 5,823,649 | A * | 10/1998 | Hinrichs | 312/334.45 |
| 5,975,593 | A * | 11/1999 | Cress | 292/86 |
| 6,042,157 | A | 3/2000 | Shimotsu | |
| 6,173,593 | B1 | 1/2001 | Liermann | |
| 6,250,694 | B1 | 6/2001 | Weiland | |
| 6,250,730 | B1 | 6/2001 | Roth et al. | |

(Continued)

*Primary Examiner* — Janet M Wilkens
*Assistant Examiner* — Daniel Rohrhoff
(74) *Attorney, Agent, or Firm* — Richard D Rhodes

(57) ABSTRACT

A latch is provided for engagement between the closure member of an enclosure and the frame of the enclosure, the latch comprising a member with a first portion, including a hook portion to engage the frame and prevent the closure member frame from fully opening. The first portion and a complementary second portion each may include buttressing wall sections, one of which must be deflected from alignment with the other to allow the hook portion to be deflected and clear the frame. The latch may be useful as a childproof device to prevent unwanted entry into the enclosure. In addition, a pin may extend from the hook portion and engage a hole in the frame to provide a third feature which must be actuated in order to fully open the closure member.

14 Claims, 5 Drawing Sheets

U.S. PATENT DOCUMENTS

| | | | | |
|---|---|---|---|---|
| 6,431,616 | B1 | 8/2002 | Julian | |
| 6,481,811 | B1 * | 11/2002 | Marsh | 312/333 |
| 6,682,156 | B2 | 1/2004 | Herrington | |
| 6,764,148 | B2 | 7/2004 | Morris et al. | |
| 6,851,286 | B2 | 2/2005 | Dube' et al. | |
| 6,942,257 | B2 | 9/2005 | Wong et al. | |
| 6,955,380 | B1 * | 10/2005 | Barr | 292/84 |
| 7,261,329 | B1 * | 8/2007 | Julian et al. | 292/84 |
| 7,344,209 | B1 * | 3/2008 | Miyashiro | 312/333 |
| 7,452,011 | B1 * | 11/2008 | Lind | 292/87 |
| 7,547,050 | B1 * | 6/2009 | Miglieri et al. | 292/84 |
| 7,686,353 | B2 * | 3/2010 | Lewis et al. | 292/19 |

* cited by examiner

CHILD-PROOF SAFETY LATCH

CROSS REFERENCE TO RELATED APPLICATION

This application claims the benefit of U.S. Provisional Application No. 60/993,121 filed on Sep. 10, 2007, the teachings of which are incorporated by reference.

FIELD OF INVENTION

The present invention relates to latches for drawers, cabinet doors and the like, and, more particularly, to "child-proof" latches that include features which make them difficult to be actuated by small children.

BACKGROUND OF THE INVENTION

Drawers are commonly used in daily life in kitchens, bedrooms, offices, etc. to store a wide range of articles, some of which may be harmful to children. Small children may also attempt to climb on, or even in, drawers and cabinets in an effort to hide. Drawers and cabinets may house many types of materials which may be potentially hazardous to children such as medicines, household cleaners, knives, tools, paint, etc.

To prevent young children from accessing these storage areas, numerous items have been patented and sold, most of a multi-piece assembly. Generally, some sort of a longitudinal member with a hook portion is attached to the inside surface of a drawer or door to limit the amount the drawer or door may be opened. The hook portion may engage with a stop installed on a frame portion of the cabinet as the drawer or door is withdrawn. Only a small space may then remain for an adult to insert their finger to depress the longitudinal member such that the hook may clear the stop on the frame of the enclosure.

While the disengagement of the latch is relatively easy for an adult, the latches are intended to be difficult to manipulate by a child. However, since the actuation may be easily learned by an attentive child, the latch may soon prove inadequate.

In many cases, these latches require at least two components, which need alignment during installation or adjustment after installation. These components generally include a stop portion, or catch, attached to the enclosure and a hook portion attached to the inside of the drawer. This mechanism may further require a biasing member (springs, etc.) to bias the hook member against the stop member.

Other latch designs have included complex assemblies which challenge the manual dexterity of children and which may require the broad hand span of an adult to actuate. However, children may defeat these by using two hands.

Some of the current latches may require attachment to the exterior of the enclosure and look unsightly or attract unwanted attention.

Examples of previously disclosed latches are described in U.S. Pat. No. 4,139,249 to Hillman; U.S. Pat. No. 3,397,001 to Freidman; U.S. Pat. No. 3,889,992 to Shelton; U.S. Pat. No. 5,823,649 to Hinrichs; U.S. Pat. No. 4,505,526 to Leck; U.S. Pat. No. 3,850,463 to Hawkins; U.S. Pat. No. 5,626,372 to Vogt; U.S. Pat. No. 5,645,304 to Richardson, et al.; U.S. Pat. No. 5,795,044 to Trewlulla, Jr. et al.; U.S. Pat. Nos. 2,759,782; 3,519,299 and 4,286,809 to Goodwin; U.S. Pat. No. 4,191,411 to Rodgers; U.S. Pat. No. 4,378,949 to Chrones; U.S. Pat. No. 4,416,477 to Bialobrziski, et al.; U.S. Pat. No. 4,632,438 to McKinney; U.S. Pat. No. 4,717,184 to Boyce; U.S. Pat. No. 5,445,451 to Harmony; U.S. Pat. No. 5,647,618 to Lambreth; U.S. Pat. No. 5,769,517 to Carde; U.S. Pat. No. 6,250,730 to Roth, et al.; U.S. Pat. No. 6,942,257 to Wong, et al. and U.S. Pat. No. 6,955,380 to Barr.

What is needed is a one-piece "child-proof" safety latch that is easy to install on the inside surface of a drawer, or door, and which includes more than one feature which must be actuated to release the latch. Thus, a drawer, or cabinet door, may only be partially opened and its contents kept secure from children. Upon actuation of the more than one feature by an adult, the contents may become accessible.

It is thus an object of the present invention to provide a one-piece latch which may preferably be molded of plastic to provide a low cost safety latch.

It is a further object of the present invention to provide a childproof safety latch which may be easily installed on the interior of a drawer or door without the need for power tools or taking measurements.

It is a further object of the present invention to provide a safety latch which requires at least two cooperating efforts, a deflection of a sidewall prior to the depressing of a resilient member to allow a hook portion to clear an engaging surface.

SUMMARY OF THE INVENTION

In an exemplary embodiment, a childproof latch is provided for attachment to a closure panel, the closure panel being moveable relative to a frame, the latch comprising a generally C-shaped member having a base portion, the base portion configured for attachment to the closure member, an first portion, disposed longitudinally, and extending forward from the base portion, the first portion further including a hook portion for engagement with a cabinet frame, and a second portion disposed opposite at least a portion of the first portion that may extend forward from the base portion. In an application for a drawer, the first portion may be disposed above the second portion, while for a cabinet door; the first portion may be disposed beside the second portion. The latch further may comprise a buttressing wall section extending inwardly from each of the first portion and the second portion and at least one opening located between the first and the second portions, wherein at least one of the buttressing sections may be deflected away from alignment with the opposite buttressing section and allow the hook section of the first portion to clear any interference with the frame.

In a second exemplary embodiment, a safety latch in combination with a closure for a cabinet for preventing access to the cabinet by preventing full opening of the closure is provided, the latch comprising a generally C-shaped member having a base portion, the base portion configured for attachment to the closure member, a first portion disposed longitudinally that may extend forward from the base portion, of the first portion further including a hook portion for engagement with a cabinet frame, and a second portion disposed opposite at least a portion of the first portion and extending forward from the base portion. In an application for a drawer, the first portion may be disposed above the second portion, while for a cabinet door; the first portion may be disposed beside the second portion. The latch may further comprise a buttressing wall section extending inwardly from each of the first portion and the second portion and at least one opening located between the first and the second portions, wherein at least one of the buttressing sections may be deflected away from alignment with the opposite buttressing section and allow the hook section of the first portion to clear any interference with the frame.

In method form the present invention provides a means of temporarily latching a closure member to a frame member, the method comprising the steps of:

(a) providing a closure member adjacent a frame member, the closure member having an inside surface;

(b) providing a generally C-shaped member having a base portion, the base portion configured for attachment to the closure member; a first portion, disposed longitudinally and extending forward from the base portion, the first portion further including a hook portion for engagement with a closure frame, and a second portion disposed opposite at least a portion of the first portion and extending forward from the base portion. At least one opening may be located between the first and the second portions and a buttressing wall section may extend inwardly from each of the first portion and the second portion, wherein at least one of the buttressing sections may be deflected away from the alignment with the opposite buttressing section and allow the hook section of the first portion to be deflected and clear any interference with said frame;

(c) installing the C-shaped member on an inside surface of the closure member;

(d) engaging the closure member with the frame member;

(e) moving the closure member away from the frame until the hook portion engages the frame member at a first position;

(f) deflecting one of the buttressing walls laterally relative to the other buttressing wall such that they do not align;

(g) deflecting the first portion sufficiently to allow the hook portion to clear the frame portion; and (h) moving the closure member to a second position further away from the frame portion to allow the closure member to become unlatched.

The method may further include providing a pin extending from the hook portion, which engages a hole in the frame during step (e), the pin having a length and wherein the closure member must be moved towards the frame by a distance greater than the length of the pin before step (g) takes place.

In accordance with the present invention, a childproof latch is provided that may be difficult for a child to physically actuate as it provides more than one feature which must be actuated, or overcome, in order to gain access to a drawer or cabinet. Thus, the childproof latch in accordance with the present invention, may comprise a substantially C-shaped, preferably molded, plastic article having a base portion for attachment to the inside of a drawer or cabinet door, a first longitudinal portion that may extend forward from the base portion for engagement with a cabinet frame, and a second portion that may extend forward from the base portion opposite the first portion, the portions being at least partially separated by an opening. The first longitudinal section may be disposed substantially horizontally and may include a hook portion to engage a cabinet frame, which may be adjacent the drawer or door. By being disposed horizontally, the latch of the present invention may be preferably installed with its long axis disposed normal to the face of the door or drawer it is intended to latch. The opening may allow the first portion to be pivoted towards the second portion to clear the interference of the hook portion with the cabinet frame. Buttressing wall sections may extend inwardly toward each other from the first and second portions, respectively, and may frame the aforementioned opening. The buttressing wall sections may substantially interfere with one another to prevent deflection of the hook portion of the first portion and prevent more than limited opening of the drawer or door. One of the buttressing sections may be deflected sideways, that is laterally from the longitudinal axis of the latch, to be offset from the other and allow the first portion of the latch to be deflected sufficiently to clear the interference of the hook with the frame. Thus, the opening in the latch provides an area around which buttressing walls may pivot. In addition, a section of the first portion longitudinal member, adjacent the hook portion, may preferably be thinned or weakened to provide a pivot point to reduce the force required to move the hook portion past the enclosure frame when the drawer is being closed. The one-piece latch is preferably molded of a somewhat resilient plastic to provide the bias of the hook portion against the enclosure frame. The base portion further may include an outer perimeter which is wider than the thickness of the buttressing sections to provide room for the buttressing section to be deflected laterally and provide a substantial thickness for attachment to the drawer or door inner surface.

The latch may be mounted on the inside surface of a drawer or cabinet door such that the drawer or door may only be opened a desired amount as dictated by the positioning of the latch.

An adult may be able to reach into the open space provided by the latch of the present invention and deflect the first buttressing wall section laterally from alignment with the second buttressing wall section, and then depress the first longitudinal portion such that the hook member may clear the frame of the enclosure and the drawer may be fully opened.

BRIEF DESCRIPTION OF THE DRAWINGS

These and other objects, features and advantages of the present invention will become apparent to those skilled in the art upon reference to the following written description and accompanying drawings in which.

DETAILED DESCRIPTION OF THE PREFERRED EMBODIMENTS

Figure 1A:
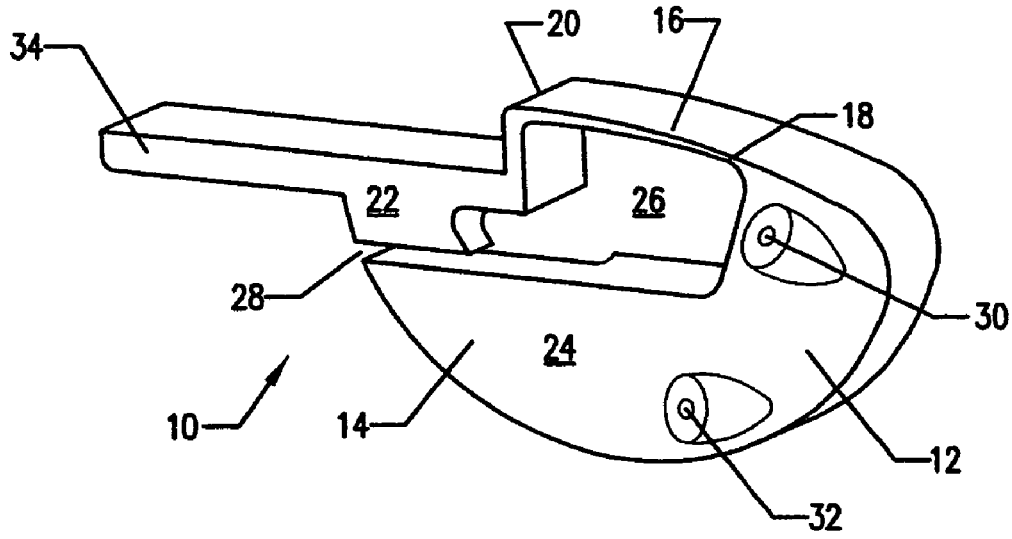
FIG. 1A is a perspective view of an exemplary latch, in accordance with the present invention.

The present invention is described more fully hereinafter with reference to the accompanying drawings, in which preferred embodiments of the invention are shown. This invention, may, however, be embodied in many different forms and should not be construed as limited to the embodiments set forth herein; rather, these embodiments are provided so that this disclosure will be thorough and complete, and will fully convey the scope of the invention to those skilled in the art.

For elements common to the various embodiments of the invention, the numerical reference character between the embodiments is held constant, but distinguished by the addition of an alphanumeric character to the existing numerical reference character. In other words, for example, an element referenced at 10 in the first embodiment is correspondingly referenced as 10A, 10B, and so forth in subsequent embodiments. Thus, where an embodiment description uses a reference character to refer to an element, the reference character applies equally, as distinguished by alphanumeric character, to the other embodiments where the element is common.

Referring now to FIG. 1A, a first exemplary embodiment of a childproof latch, according to the present invention, is illustrated in perspective view. The latch 10 may comprise a substantially C-shaped member, preferably molded of a resilient plastic and including a first portion 16, and a second portion 14 extending from a base portion 12. The childproof latch may be attached to the inner surface of a drawer (see FIG. 2) to restrict the amount that the drawer may be easily opened. The first portion 16 may comprise a longitudinal member having a hook or detent portion 20 for engaging a frame portion of the enclosure in which the drawer slides and may include an extension 34 for locating the latch 10 relative to the drawer front and the top of the side of the drawer on the inside surface. Holes 30 and 32 may be provided in the base portion 12 for attachment to the inside surface of a side of the drawer with mechanical fasteners, such as small nails or screws. Double-sided tape or hook-and-loop type fasteners, such as Velcro® may be used. The holes are preferably at diverging angles to one another to assist in locating and securing the latch 10 to the inside of the drawer. By diverging the holes, after one nail or screw has secured the latch to the inside surface of a drawer, the other nail or screw may be driven in, and in doing so may tighten against the first. In addition, any force applied to the latch, as by opening or closing the drawer, may tighten the latch to the drawer.

As part of the essentially C-shaped design of the latch 10, an opening 26 may lie between the first 16 and second 14 portions to provide an area around which the first portion 16 may pivot relative to the base 12. A section 18 of the first portion 16 may be thinned or otherwise weakened to provide an additional pivot point to assist in moving the hook portion 20 past the frame of the enclosure that the drawer slides in, when closing the drawer. The first member 16 may be thinned about 20%-80% of its full thickness to provide the desired flexing action. Preferably, the latch 10 may also flex around any other radii formed in the opening 26 of the latch to make it easy to deflect the latch first portion 16 downward during closing of the drawer. Thus, upon closing the drawer or door from a fully open position, the frame of the enclosure may encounter first portion 16 and ride along it deflecting the hook portion 20 away from the frame by flexing the first portion around the thinned or weakened area 18, or other radius points. Once the drawer is sufficiently closed to clear the hook portion, the hook portion 20 may recover to its as-molded position due to the resilient nature of the plastic from which it was molded. The hook portion may then be in an interference position to allow the drawer to only be opened a small amount, as the hook portion 20 will interfere with the frame 54 (see FIG. 2). The amount that the drawer may be opened without actuating the latch may be controlled by the fore/aft positioning of the latch on the inside of the drawer, that distance usually being the length of extension 34. Projecting inwardly from the first 16 and second 14 portions are buttressing walls 22 and 24, respectively, that align with one another to provide an interference to the hook portion 20 being deflected downward and clearing the frame of the enclosure. The buttressing walls 22, 24 may be preferably separated by a narrow gap 28. By buttressing, it is meant that two walls lie adjacent one another and that applying a force which will cause the walls to engage will cause one wall to support the other.

It is also contemplated that the latch of the present invention may be formed without a slot 28 and that that section of the latch 10 might be formed by a thin web of material, preferably flexible, that might extend or bend and allow the walls to be offset one from the other.

Figure 1B:
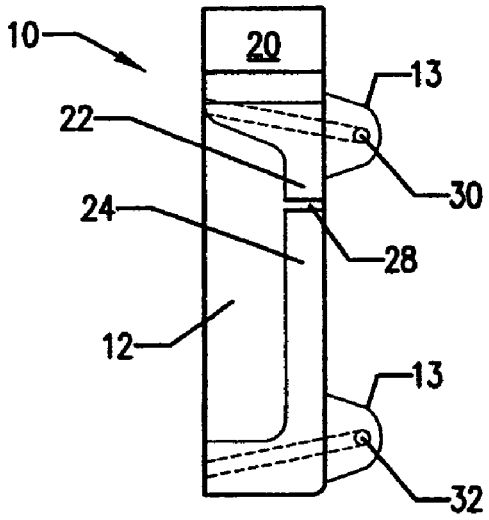
FIGS. 1B and 1C are end views of the exemplary latch of FIG. 1, illustrating the buttressing walls substantially interfering, and deflected for clearance, respectively.

Turning to FIG. 1B, an end view of the latch 10 of the present invention is shown. This end view illustrates the periphery of the base portion 12 being somewhat wider than the thickness of the buttressing walls 22 and 24, and the hook portion 20 in a fully extended, un-deflected position. Flanges 13 may protrude from the side of the base to allow easy fastening of the latch 10 to the inside of a drawer. Means of attachment including, but not limited to, nails, screws, adhesive and hook-and-loop fasteners.

Figure 1C:
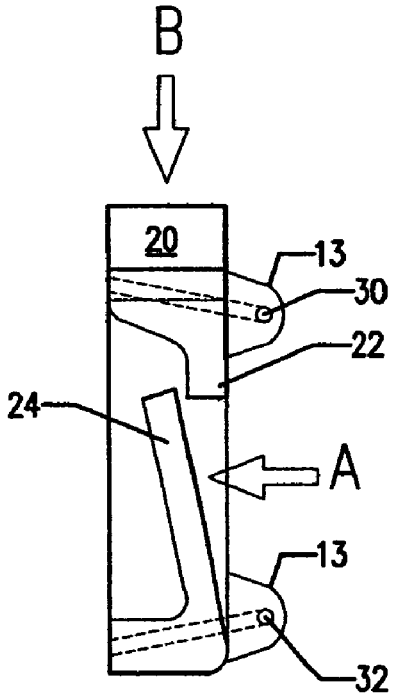

FIG. 1C illustrates the deflected condition of the latch 10 of the present invention, wherein the second buttressing wall 24 has been deflected laterally (note Arrow A) to allow the first wall 22 and the hook portion 20 to be deflected downward (note Arrow B) such that the hook portion may be in a position to clear the frame of the enclosure and the drawer may be opened freely. The resilient nature of the plastic from which the latch is molded may cause the wall 24 and hook portions 20 to return to their original positions once released. It should be appreciated that "laterally" and "downward" are relative terms and that the latch may be installed in a plane essentially perpendicular from that shown in FIGS. 1A and 2, as on a cabinet door. In that case the walls would be deflected downwardly (or upwardly) and the hook portion laterally (to the horizontal). It is further contemplated that the latch of the present invention may be installed at any angle, not just in a vertical or horizontal plane, including 180° from either horizontal or vertical, and all increments in between.

FIG. 1C thus illustrates the combination of features which must be actuated to allow a drawer to open, first a lateral deflection of one of the walls 22 or 24 followed by a downward deflection of the first portion 16 of the latch to allow the hook portion 20 to clear the frame of an enclosure. While the slot 28 in FIGS. 1B and 1C is shown as essentially horizontal, it is contemplated that the slot could be on an angle or slanted to reduce the lateral deflection required to offset the walls, making actuation of the latch easier. In contrast, it is further contemplated that the matching ends of the buttressing walls that form slot 28 could include complementary features to make lateral deflection even more difficult. Thus, the complementary surfaces could include a stepped portion, tongue and groove, depression and projection, etc.

Figure 2:
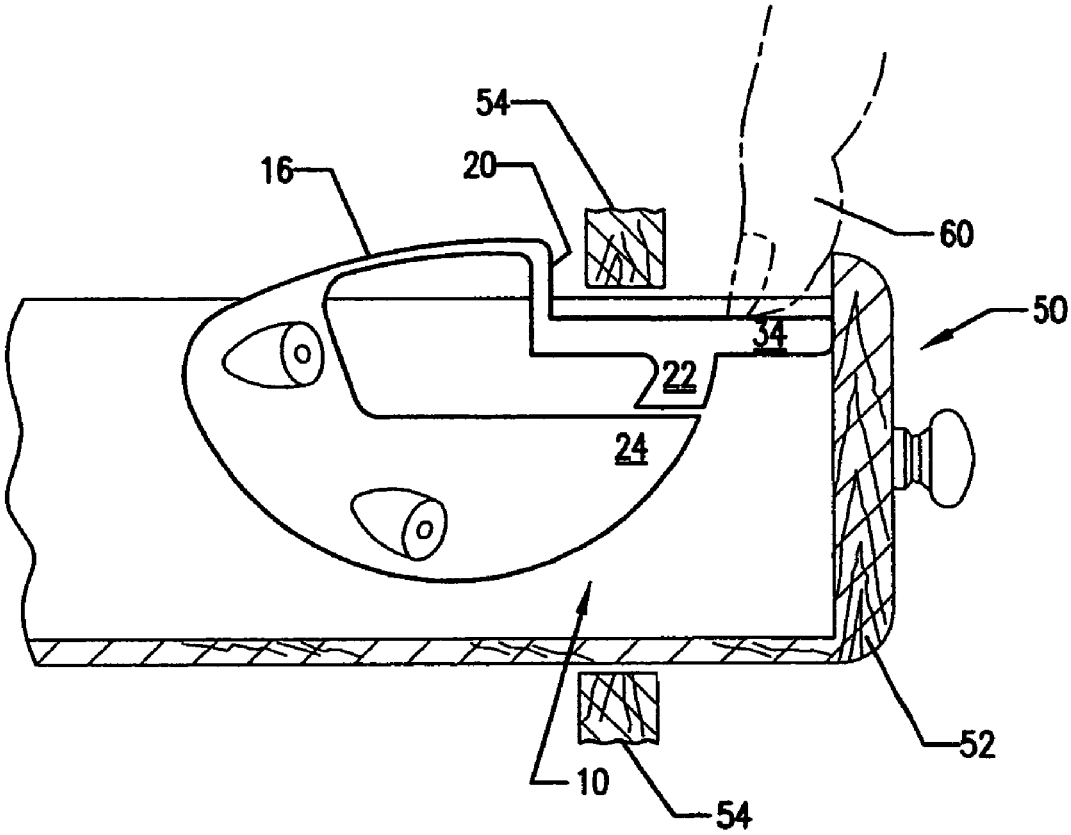
FIG. 2 is a sectional view of a drawer in combination with a latch, according to the present invention, installed in place.

FIG. 2 illustrates a childproof latch 10 of FIG. 1A, according to the present invention, installed on an inside surface of a drawer 50. The drawer includes a front 52 and a frame 54 that makes up a portion of the enclosure which the drawer resides in. The latch 10 is shown with the hook portion 20 in a nearly engaged position with the frame 54 such that the drawer 50 may only be opened a few inches. As shown, there may be sufficient space for a thumb 60 and finger to be inserted into the narrow open space such that a buttressing wall 22 or 24 may be deflected laterally and then the hook portion 20 deflected downward to clear the frame 54 and allow the drawer to fully open. Alignment of the locating extension 34 with the inside of the drawer front 52 determines the amount of open space provided for inserting the thumb and finger and actuating the latch. Sequentially, actuating this combination of features and actions is generally believed to be beyond the ability of a young child.

Figure 3:
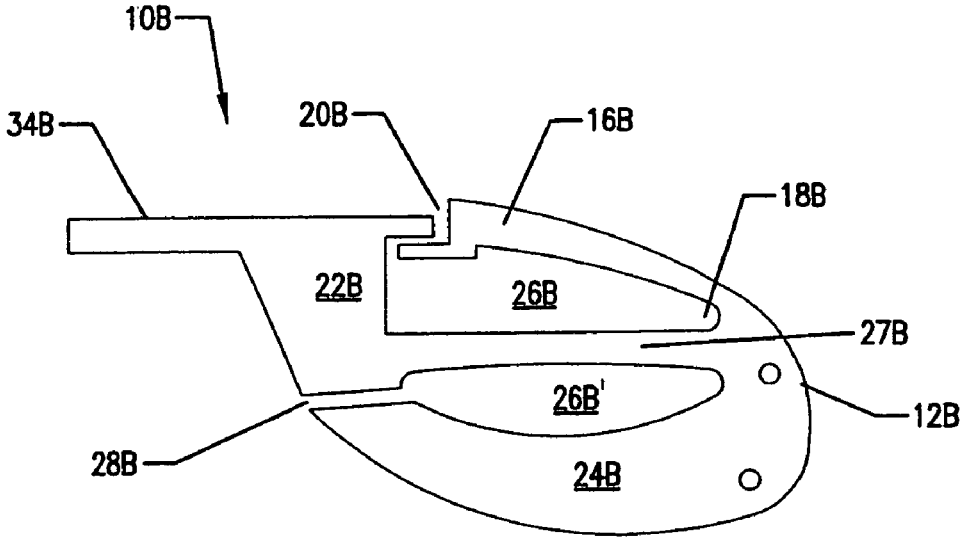
FIG. 3 is a side view of another exemplary embodiment of a latch, according to the present invention.

FIG. 3 illustrates an alternate exemplary embodiment of a latch 10B, according to the present invention, wherein the first portion 16B is relatively short and terminates at about the hook portion 20B to allow an even second force to close the drawer and deflect the hook portion. In this embodiment, separate openings 26B and 26B' may be provided for allowing the hook portion 20B to be deflected downward and the second wall portion 24B deflected laterally. Here, a center portion 27B may separate the two openings and connect the first buttressing wall 22B to the base portion 12B and the extension 34B.

Figure 4:
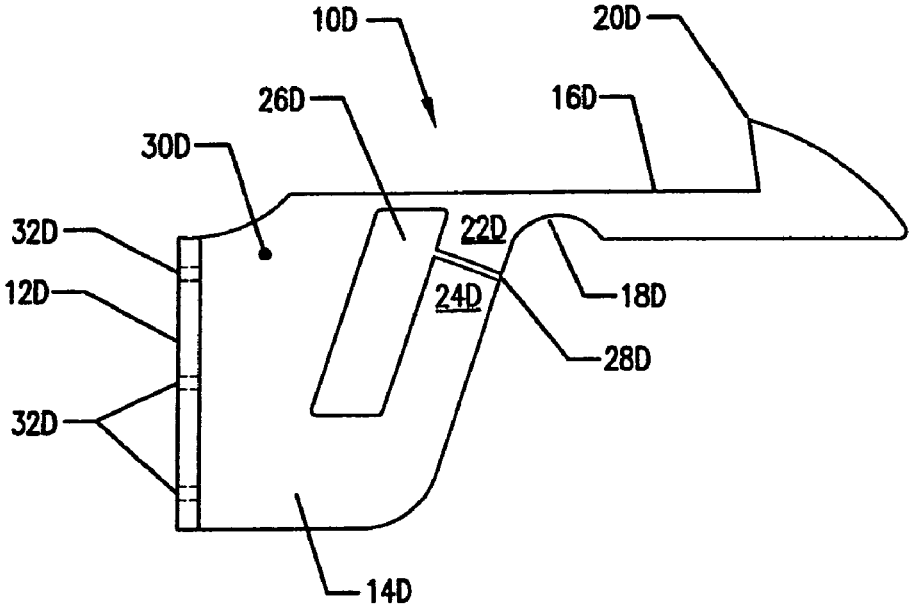
FIG. 4 is a side view of another exemplary embodiment of a latch, according to the present invention.

FIG. 4 illustrates another exemplary embodiment of the childproof latch of the present invention wherein the opening 26D may be relatively small and the hook portion 20D may be located near the end of the first portion 16D in a cantilevered position. Again, the first portion 16D may include a thinned or weakened portion 18D which allows for easy closing of the drawer. The thickness of the first portion may be reduced from about 20%-80% of the full thickness to provide easy deflection. As shown in 18D, the thinning may be radiused or alternatively, may be in the form of a somewhat sharper notch. Buttressing walls 22D, 24D may once again preferably be separated by a thin slot 28D. This embodiment illustrates the base portion 12D at a location to engage the inside of a drawer front and further illustrates the base 12D including holes 32D for use in attaching the latch. Hole 30D is provided for engaging the latch to the side of a drawer or shelf of a cabinet.

Figure 5:
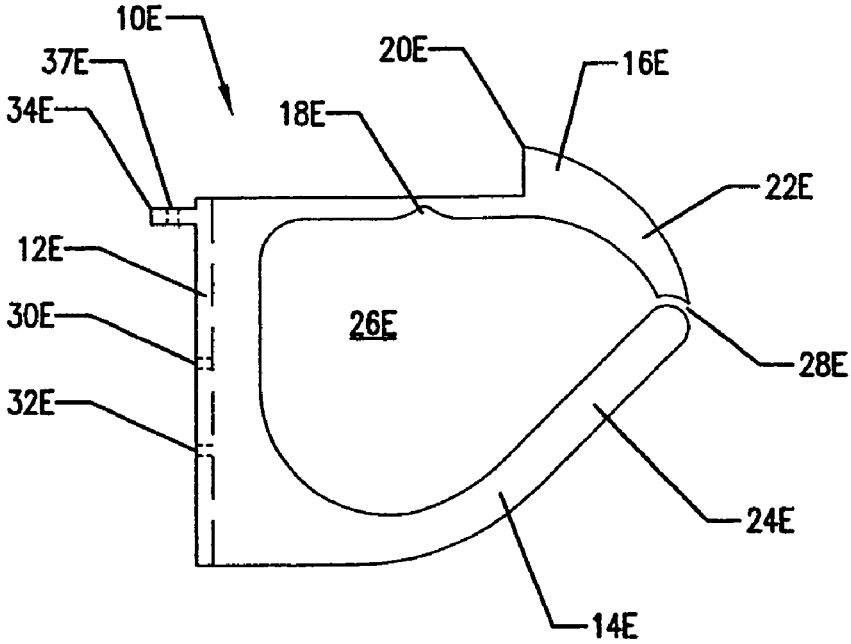
FIG. 5 is a side view of another exemplary embodiment of a latch, according to the present invention.

FIG. 5 illustrates still another exemplary embodiment of the childproof latch, according to the present invention, where a large opening 26E may exist between the first 16E and second 14E portions and the buttressing walls 22E and 24E may be formed by the first and second portions. In this embodiment, the base 12E may be located at the front inside of the drawer and attachment means may connect the latch 10E to the inside of the drawer front through holes 30E and 32E rather than to an inside of the side of a drawer. In this embodiment, the ends of the first 16E and second 14E portions that lie adjacent slot 28E may be thinner in cross-section than the base 12E to form the buttressing walls 22E, 24E. Being thinned allows for ease of deflection laterally.

Figure 6:
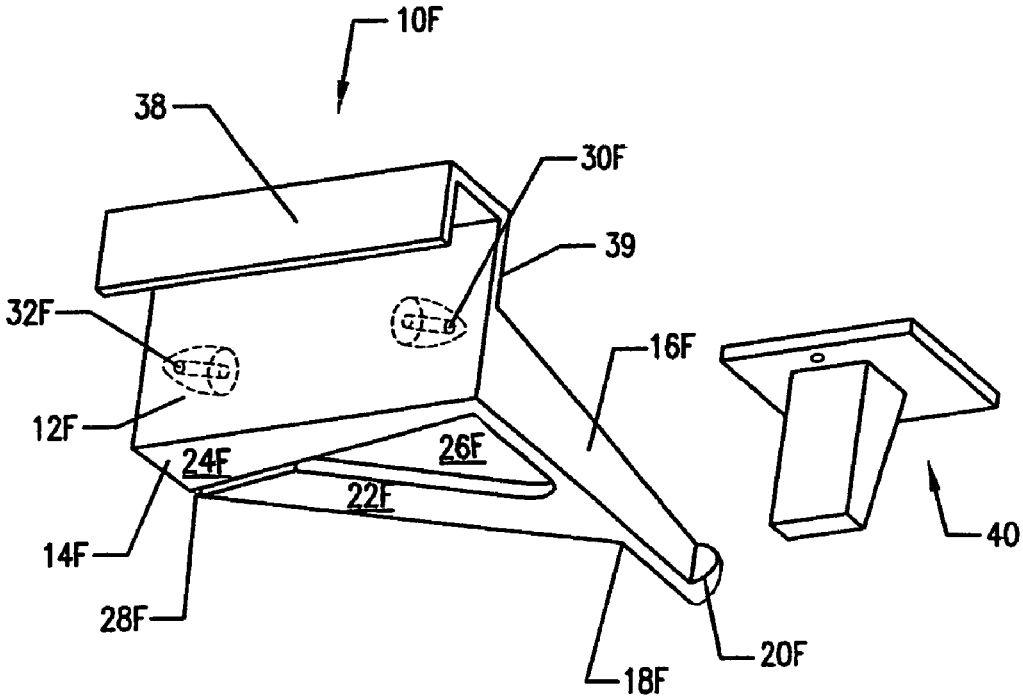
FIG. 6 is a perspective view of another exemplary embodiment of the latch, according to the present invention, that may be used with a cabinet door.

While any of the embodiments of the childproof latch, according to the present invention, may find use on other closures means than a drawer, for instance on a cabinet door, or dishwasher door or oven door, FIG. 6 illustrates a two-piece design that may be useful on a cabinet which may not include a center post for engaging the hook portion of the latch. Rather than orienting the latch vertically to engage a first frame of a cabinet enclosure, the latch 10F may be attached in a horizontal plane to the top of the door (or bottom for tall doors) using holes 30F, 32F. A flange section 38 may overlie the first edge of the door to locate the latch 10F. The flange section 38 may have a downstanding leg portion 39 which positions the "first" portion 16F to clear the frame of the enclosure. As in the other embodiments, buttressing walls 22F and 24F may extend towards each other from "first" and "second" portions 16F and 14F, respectively. A thinned or weakened section 18F of the first portion 16F may allow easy closing of the latch past separate stop 40. Stop 40 may be attached to the underside of the top (or bottom if a tall door) of the enclosure to prevent the door from opening by interfering with the hook portion 20F.

Figure 7A:
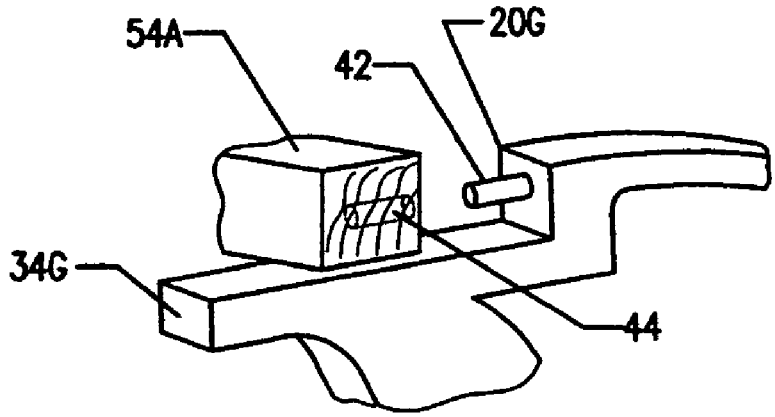
FIG. 7A is another exemplary embodiment of a latch, according to the present invention, illustrating a third feature for limiting access to a drawer.
Figure 7B:
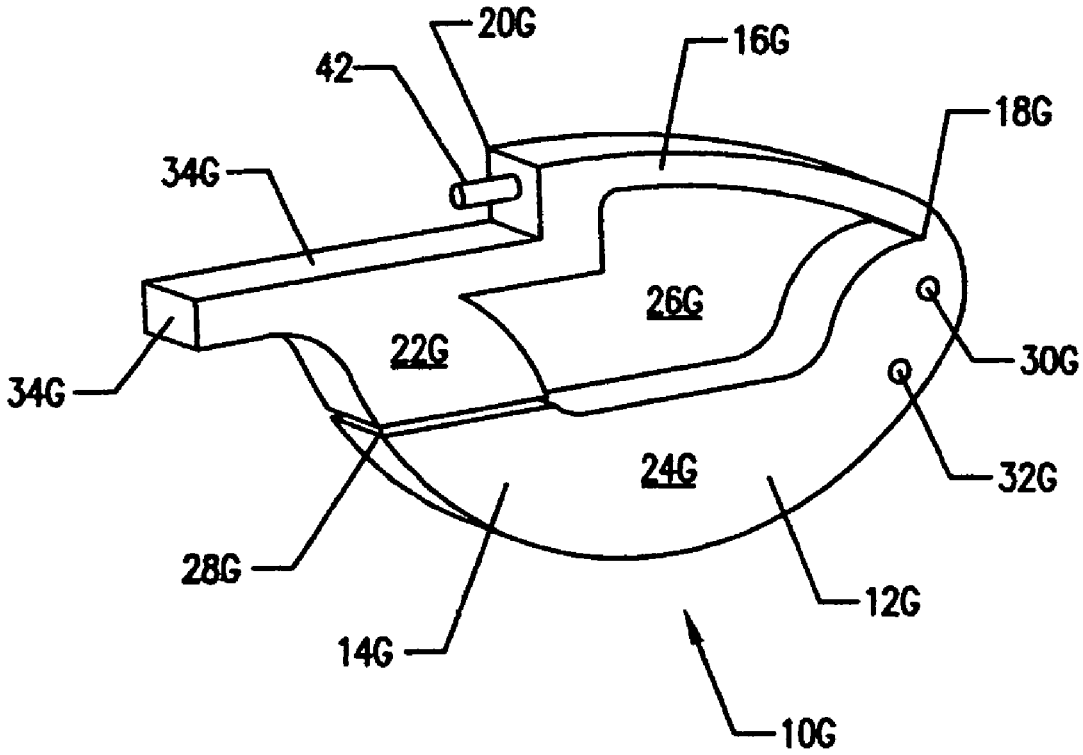
FIG. 7B is an enlarged view of the first portion of FIG. 7A.

FIGS. 7A and 7B illustrate another exemplary embodiment of a childproof latch, according to the present invention wherein a third feature is included to make the actuation of the latch 10G even more difficult. In this embodiment, as shown in FIG. 7B, a pin 42 may be been added to the hook portion 20G, the pin 42 protruding from the hook portion 20G in the direction of the locating extension 34G, or in the direction of withdrawal of the drawer from its enclosure.

As shown in FIG. 7A, this pin 42 may engage a hole 44 in the inside of the frame 54A of the enclosure. Thus, when the drawer is withdrawn sufficiently for the hook portion 20G to engage the frame 54A, the pin 42 may engage the hole 44 and make it is impossible to depress the hook portion 20G downward to clear the frame 54A and open the drawer, even if the buttressing walls 22G, 24G are deflected from interfering with one another. To actuate the latch 10G, the drawer must be closed slightly to disengage the pin 42 from the hole 44 and allow the hook portion 20G to be depressed, after one of the buttressing walls, 22G or 24G, has been deflected to clear the other wall.

Further, the locating extension 34G may include a downstanding leg, which may fit over the edge of a drawer front to locate the latch 10G in both a horizontal and vertical position. Preferably for all of the embodiments of the latch according to the present invention, the extension portion 34 (34G, etc.) may substantially lie flush with the top of the side of the drawer to which it is mounted.

Thus, a childproof latch is provided which may be easily installed on the inside of a closure member without power tools or the need to measure. The latch may allow partial opening of the closure member but requires a combination of actions to be carried out so that the enclosure which the member closes may be freely accessed.

It should be understood that although specific embodiments of the present invention have been described herein in detail, such descriptions are for purposes of illustration only and modifications may be made thereto within the scope of the invention.

The description and drawings illustratively set forth the presently preferred invention embodiment. We intend the description and drawings to describe this embodiment and not to limit the scope of the invention. Obviously, it is possible to modify these embodiments while remaining within the scope of the following claims. Therefore, within the scope of the claims one may practice the invention otherwise than as the description and drawings specifically show and describe.

What is claimed is:

1. A childproof latch for attachment to a closure panel, the closure panel being moveable relative to a frame, the latch comprising:

a generally C-shaped member having a base portion, the base portion configured for attachment to said closure member;

a first portion, disposed longitudinally and extending from said base portion, the first portion further including a hook portion for engagement with said frame; and a second portion disposed opposite said first portion and extending from said base portion;

a buttressing wall section extending inwardly from each of said first portion and said second portion; and at least one opening located between said first and said second portions, wherein at least one of said buttressing sections is deflected out of alignment with the opposite buttressing section and allowing the hook section of the first portion to be depressed and clear any interference with said frame.

2. The childproof latch of claim 1, wherein said closure panel is a drawer front, or a cabinet door.

3. The childproof latch of claim 2, wherein said base portion may be attached to the interior of said drawer or door.

4. The childproof latch of claim 1, wherein said at least one opening provides a pivot area for said first portion to move relative to said base portion.

5. The childproof latch of claim 1, wherein said latch comprises molded plastic.

6. The childproof latch of claim 5, wherein said molded plastic comprises a resilient material for providing biasing of said first member against said frame.

7. The childproof latch of claim 1, wherein said first member is thinned or weakened locally adjacent said hook portion to allow easier closure of said panel relative to said frame.

8. The childproof latch of claim 1, wherein said base portion includes a width and the buttressing sections include a thickness and said thickness is less than said width.

9. The childproof latch of claim 1, wherein said base portion is attached to said closure panel by one or more of mechanical fasteners, adhesives and hook and loop fasteners.

10. The childproof latch of claim 1, further including a pin which extends from the hook portion and engages a hole in the frame.

11. A method of temporarily latching a closure member to a frame member, the method comprising the steps of:

(a) providing a closure member adjacent a frame member, said closure member having an inside surface;

(b) providing a generally C-shaped member having a base portion, the base portion configured for attachment to said closure member; a first portion, disposed longitudinally and extending from said base portion, the first portion further including a hook portion for engagement with said frame; and a second portion disposed opposite at least a portion of the first portion and extending from said base portion; wherein at least one opening is located between said first and said second portions, wherein a buttressing wall section extends inwardly from each of said first portion and said second portion and at least one of said buttressing sections is deflected out of alignment with the opposite buttressing section and allowing the hook section of the first portion to be depressed and to clear any interference with said frame;

(c) installing said C-shaped member on the inside surface of said closure member;

(d) engaging said closure member with said frame member;

(e) moving said closure member away from said frame until the hook portion engages said frame member at a first position;

(f) deflecting one of said buttressing walls relative to the other buttressing wall such that they do not align;

(g) deflecting said first portion sufficiently to allow said hook portion to disengage from said frame portion; and (h) moving said closure member to a second position further away from said frame portion to allow said closure member to become unlatched.

12. The method of claim 11, wherein step (f) comprises deflecting said one of said buttressing walls in a vertical plane.

13. The method of claim 11, wherein said hook portion further includes a pin which engages a hole in said frame during step (e), the pin having a length, and wherein the closure member must be moved towards the frame by a distance greater than the length of said pin before step (g) takes place.

14. A safety latch in combination with a closure for a cabinet for preventing access to the cabinet by preventing full opening of the closure, the latch comprising:

a generally C-shaped member having a base portion, the base portion configured for attachment to said closure member; a first portion, disposed longitudinally, and extending from said base portion, the first portion further including a hook portion for engagement with said frame; and a second portion disposed opposite at least a portion of the first portion and extending from said base portion;

a buttressing wall section extending inwardly from each of said first portion and said second portion; and at least one opening located between said first and said second portions, wherein at least one of said buttressing sections is deflected out of alignment with the opposite buttressing section and allowing the hook section of the first portion to be depressed and to clear any interference with said frame.

* * * * *